United States Patent [19]

Kinoshita et al.

[11] Patent Number: 4,780,231

[45] Date of Patent: Oct. 25, 1988

[54] DIUREA GREASE COMPOSITION

[75] Inventors: Hirotugu Kinoshita; Masaru Mishima; Makoto Sekiya; Koji Oyama, all of Kawasaki, Japan

[73] Assignee: Nippon Oil Co., Ltd., Tokyo, Japan

[21] Appl. No.: 40,229

[22] Filed: Apr. 20, 1987

[30] Foreign Application Priority Data

Apr. 22, 1986 [JP] Japan ..... 61-91229

[51] Int. Cl.[4] ..... C10M 133/20

[52] U.S. Cl. ..... 252/51.5 A

[58] Field of Search ..... 252/51.5 A

[56] References Cited

U.S. PATENT DOCUMENTS

| | | | |
|---|---|---|---|
| 4,261,844 | 4/1981 | Cuscurida | 252/51.5 A |
| 4,261,845 | 4/1981 | Caruso | 525/51.5 A |
| 4,263,156 | 4/1981 | Caruso | 252/51.5 A |
| 4,529,530 | 7/1985 | Shimizu et al. | 252/51.5 A |
| 4,661,276 | 4/1987 | Stemke | 252/51.5 A |
| 4,668,411 | 5/1987 | Yasui et al. | 252/51.5 A |

*Primary Examiner*—Jacqueline V. Howard

*Attorney, Agent, or Firm*—Malcolm B. Wittenberg

[57] ABSTRACT

A dilurea grease composition contains a lubricant base oil and a thickener. The thickener essentially consists of a mixture of at least two diurea compounds each being represented by the following general formula (I) of:

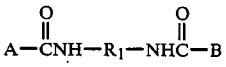

wherein $R_1$ is a difunctional aromatic hydrocarbon residue, and A and B each stands for an amino group represented by the general formula (II) of $R_2$—NH—(where $R_2$ stands for a cyclohexyl group, a group derived from cyclohexyl or an alkyl group) or an amino group represented by the general formula (III) of

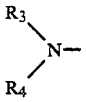

(where $R_3$ $R_4$ each stands for cyclohexyl group or a group derived from cyclohexyl). The ratio in percentage of the numbers of the amino groups (III) to the total numbers of the amino groups (III) plus the amino groups (II) ranges from 1 to 50%. The ratio of the numbers of the amino groups (II) wherein $R_2$ is a cyclohexyl group or a group derived from the cyclohexyl to the numbers of the amino groups (II) wherein $R_2$ is an alkyl group ranges from 174 to 4/1.

10 Claims, No Drawings

DIUREA GREASE COMPOSITION

BACKGROUND OF THE INVENTION

1. Field of the Invention

The present invention relates to a diurea grease composition, i.e. a grease composition containing a diurea compound as a thickener, and particularly to such a grease composition having excellent properties and having stability with extremely little tendency of hardening for a long time.

2. Related Art Statement

With surprising progress of heavy chemical industries in recent years, a variety of apparatuses or machines is worked under severe conditions. Under such circumstances, lubricants must have superior properties to withstand the actual conditions used. Many investigations have hitherto been made to develop a numerous varieties of lubricants. However, the appartuses or machines used in the manufacturing industries have bearings which are often exposed to relatively high temperature of higher than 150° C. even under normal operating conditions. There is a case where a high loading is applied on a bearing which is operated at ultra low speed. One of the lubricants applied in-between the bearings for smooth operation of the machines is a grease composition.

Metallic soap thickeners are predominantly used as the thickners for the greases. However, even the lithium soap grease, which is known as a universal grease, has a dropping point of about 200° C. and cannot be used at a temperature range of higher than 150° C.

A variety of thickeners has been proposed for use in grease compositions which can be used in a high temperature environment for a long time, the examples being various complex soaps, sodium terephthalamate, bentone and organic thickeners such as indanthrene. However, these thickeners known by the prior proposals have individual disadvantages. For example, calcium complex type compounds have a disadvantage that they tend to rapidly harden the grease. Sodium terephthalamate causes syneresis and separation of oil, or accelerates deterioration due to oxidation since it contains intramolecular metal atoms. Bentone is detrimental in lubricating property at high temperature for prolonged use, whereas indanthrene has bad hue and is expensive.

On the other hand, greases containing urea thickeners having various terminal groups include so-called diurea grease and tetraurea grease which have more advantageous merits over those used in the conventional greases described above. However, the tetraurea grease has disadvantages that the consistency thereof is decreased considerably as it is exposed to high temperature for a long time, and that it is hardened or softened, depending on the difference in shearing rate applied thereon to induce adverse influence in practical use. Likewise, the known diurea greases containing diurea compounds having terminal groups merely composed of alkyl groups are low in dropping point to frequently separate oil at high temperature so that they cannot be used at a high temperature environment for a long time. On the other hand, the known diurea greases containing diurea compounds having terminals groups merely composed of aromatic hydrocarbon residues are high in dropping point but they are still unsatisfactory in connection with the problem of oil separation at high temperature, with a further disadvantage that the thickening capacities thereof are equivalent or even inferior to those having alkyl terminal groups. A still further problem involved in the known diurea grease containing a diurea thickener having aromatic terminal groups is that the aromatic amines used in preparation thereof have problems including physiological toxicity to human being.

After eager investigation to overcome the problems of the aforementioned urea greases, we have found that the diurea compounds have properties well suited for use as the thickeners in greases, and that the terminal groups of the diurea compounds affect significant influence on the function of the diurea compounds. In detail, we have found a diurea compound which has superior properties when used as a thickener for a grease. The diurea compound has a cyclohexyl group or a group derived therefrom and having 6 to 12 carbon atoms or an alkyl group having 8 to 20 carbon atoms at either one of the terminal groups, the molar ratio of the cyclohexyl or derivatives thereof to the total molar equivalent of the cyclohexyl or derivatives thereof plus the alkyl group ranging from 20 to 90 mol %. The diurea grease containing the diurea compound was applied for patent and the application was published by Japanese Patent Publication No. 11156/1980.

The diurea grease disclosed by Japanese Patent Publication No. 11156/1980 has the following advantages.

(1) Change in consistency is small even after the use thereof at high temperature for a long time.
(2) It has excellent mechanical stability under shearing rates varying within a wide range.
(3) Separation of oil at high temperature is small.
(4) It has excellent water-resistant property.
(5) It exhibits powerful thickening capacity.

However, subsequent investigations on the diurea grease have revealed that the properties of the product fluctuate, depending on the difference in manufacturing conditions so that the grease becomes too hard after the lapse of time when the manufacturing conditions for the product are impertinent.

After eagar pursuit to solve the aforementioned problem of the diurea grease disclosed by Japanese Patent publication No. 11156/1980, we have found that a diurea grease containing, as a thickener, a diurea compound having terminal amino groups of three specifically defined structures has extremely superior properties. Based on the aforementioned finding, we have accomplished the present invention.

OBJECTS AND SUMMARY OF THE INVENTION

Accordingly, a principal object of this invention is to provide a diurea grease composition which has extremely little tendency of hardening with the lapse of time, in addition to all the excellent properties of the diurea grease disclosed by Japanese Patent Publication No. 11156/1980.

A more specific object of this invention is to provide a diurea grease composition having a high dropping point, excellent stability against oxidation and heating, and satisfactory water-resistant property.

A further object of this invention is to provide a diurea grease composition having mechanical stability under the condition of being applied with shearing which varies within a wide range, the change in consistency after a long time use being very small.

A still further object of this invention is to provide a diurea grease composition containing a diurea thickener which exhibits high thickening capacity so that only a little oil separation is found in a high temperature environment.

With the aforementioned objects in view, the present invention provides a diurea grease composition comprising a lubricant base oil and a thickener, the thickener consisting essentially of a mixture of at least two diurea compounds each being represented by the following general formula (I) of:

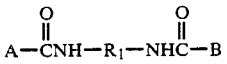

(I)

wherein $R_1$ is a difunctional aromatic hydrocarbon residue having 6 to 15 carbon atoms; and A and B may be the same or different groups and each stands for an amino group represented by the general formula (II) of $R_2$—NH— (where $R_2$ stands for a cyclohexyl group, a group derived from cyclohexyl and having 7 to 12 carbon atoms or an alkyl group having 8 to 20 carbon atoms) or an amino group represented by the general formula (III) of

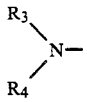

(III)

(where $R_3$ and $R_4$ may be the same or different groups and each stands for a cyclohexyl group or a group derived from cyclohexyl and having 7 to 12 carbon atoms);

wherein the ratio in percentage of the numbers of the amino groups (III) to the total numbers of the amino groups (III) plus the amino groups (II) ranges from 1 to 50%, the ratio of the numbers of the amino groups (II) wherein $R_2$ is a cyclohexyl group or a group derived from the cyclohexyl to the numbers of the amino groups (II) wherein $R_2$ is an alkyl group ranging from $\frac{1}{4}$ to 4/1, and the content of the gelatinizing agent ranging from 2 to 25 wt % based on the total weight of the composition.

DESCRIPTION OF THE INVENTION

The diurea grease composition according to this invention contains a diurea compound represented by the following general formula (I) of:

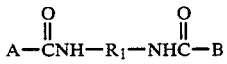

(I)

In the general formula (I), $R_1$ is a difunctional aromatic hydrocarbon residue having 6 to 15 carbon atoms, the particularly preferred examples being

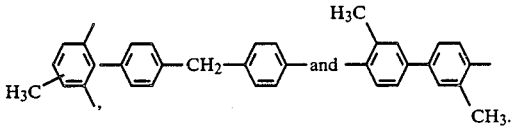

Diurea compounds represented by the general formula (I) wherein $R_1$ is a different difunctional aromatic hydrocarbon residue may be used in the composition of this invention to exhibit excellent thermal stability and excellent stability against oxidation. The groups A and B in the general formula (I) may be the same or different, and each stands for an amino group represented by the genaral formula (II) of $R_2$—NH— or an amino group represented by the general formula (III) of

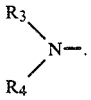

In the general formula (II), $R_2$ stands for a cyclohexyl group or a group derived from cyclohexyl and having 7 to 12 carbon atoms, or an alkyl group having 8 to 20 carbon atoms. In the general formula (III), $R_3$ and $R_4$ may be the same or different groups, and each stands for a cyclohexyl group or a group derived from cyclohexyl and having 7 to 12 carbon atoms. Specific examples of cyclohexyl group or a group derived from cyclohexyl and having 7 to 12 carbon atoms are cyclohexyl, methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl. Particularly preferable groups include cyclohexyl group and a group derived from cyclohexyl and having 7 or 8 carbon atoms, such as methylcyclohexyl and ethylcyclohexyl. Alkyl groups having 8 to 20 carbon atoms include straight chain and side chain alkyl groups, the specific examples being octyl, nonyl, decyl, undecyl, dodecyl, tridecyl, tetradecyl, pentadecyl, hexadecyl, heptadecyl, octadecyl, nonadecyl and eicosyl. Particularly preferred examples are alkyl groups having 16 to 19 carbon atoms, such as hexadecyl, heptadecyl, octadecyl and nonadecyl. The diurea compound represented by the general formula (I) and containing an amino group represented by the general formula (II) wherein $R_2$ is an alkyl group having more than 20 carbon atoms is not preferred from the economical standpoint of view.

According to a particularly important aspect of this invenvion, the terminal groups in the mixture of two or more different diurea compounds should be contained in the ratio defined in the claims. More specificaly, an amino group represented by the general formula (II) of $R_2$—NH— and/or an amino group represented by the general formula (III) of

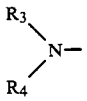

should be present in either one or both terminal groups A and/or B, and the ratio in percentage of the numbers of the amino groups represented by the general formula (III) relative to the total numbers of the amino groups (III) plus the amino groups (II) should range from 1 to 50%, preferably from 5 to 40%. If the ratio shared by the amino groups (III) is less than 1%, the grease tends to harden with the lapse of time, whereas the thickening capacity of the diurea compound is lowered if the ratio shared by the amino groups (III) is more than 50%. As the thickening capacity of the diurea compound is lowered, a larger quantity thereof must be added for thickening the grease to result in increase in production cost.

In the present invention, $R_2$ in the amino group represented by the general formula (II) of $R_2$—NH— stands for a cyclohexyl group or a group derived from cyclohexyl or an alkyl group. It is a further important feature of this invention that the ratio of the numbers of the amino groups (II) wherein $R_2$ is a cyclohexyl group or a group derived from cyclohexyl to the numbers of the amino groups (II) wherein $R_2$ is an alkyl group should range from $\frac{1}{4}$ to 4/1, preferably from 3/7 to 7/3. If the numbers of the amino groups of $R_2$—NH— wherein $R_2$ is a cyclohexyl group or a group derived from cyclohexyl are less than the defined range, the dropping point of the grease is considerably lowered. On the contrary, if the numbers of the amino groups of $R_2$—NH— wherein $R_2$ is a cyclohexyl group or a group derived from cyclohexyl are more than the defined range, a larger quantity of the diurea compound must be added for thickening the grease to thus increase the cost of the product.

In the diurea grease composition of this invention, a variety of petroleum and synthetic lubricant oils may be used as the base oil. Although a proper base oil may be selected in view of the specific application, lubricant oils extracted from petroleum are generally more favourable from the economical standpoint of view. The viscosity of the base oil is not critical, and any lubricant oils having viscosities within ordinary range may be used in the present invention. The particularly preferred viscosity range of the lubricant base oil is from 2 to 40 cSt at @210° F.

The diurea compounds represented by the general formula (I) of:

$$A-\overset{\overset{\displaystyle O}{\|}}{C}NH-R_1-NH\overset{\overset{\displaystyle O}{\|}}{C}-B \qquad (I)$$

may be prepared by any desired process. The most convenient process for the preparation thereof includes the step of reacting a diisocyanate represented by the general formula OCN—$R_1$—NCO with a primary amine represented by the general formula $R_2$—$NH_2$ and a secondary amine represented by the general formula

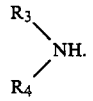

In detail, a secondary amine

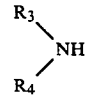

is mixed with a mixture of primary amines $R_2$—$NH_2$ (the molar ratio of cyclohexylamine or a derivative thereof to an alkyl amine should be $\frac{1}{4}$ to 4/1) in such a pre-set mixing ratio that 1 to 50% of the mixture is shared by the secondary amine, and the mixture is allowed to react with a diisocyanate. The reaction between the diisocyanate and the mixture of a primary amine and a secondary amine may proceed in the presence of a volatile solvent, such as benzene, toluene, xylene, hexane, naphtha, diisobutyl ether, carbon tetrachloride and petroleum ether or in the presence of a lubricant base oil, which serves as a solvent, at a reaction temperature of from 10° to 200° C. The reaction mixture may be agitated intimately in order to produce a uniform diurea grease. In lieu of adding a mixture of a primary amine and a secondary amine to a diisocyanate at one time, different amines may be added separately to the diisocyanate at several steps, or a mixture of a primary amine and a secondary amine may be added at several steps.

An appropriate amount of a lubricant base oil is added to the thus prepared diurea compound to prepare a grease composition, the volatile solvent being removed prior to the addition of the lubricant base oil when such a solvent is used at the step of preparing the diurea compound. However, when a lubricant base oil is used as the solvent at the step of preparing the diurea compound, the lubricant base oil may be contained in the product grease composition without being removed.

To the diurea grease composition of the present invention may be added an additive for further improving the properties thereof without impairing the advantageous characteristic features thereof. For example, to the grease composition of this invention may be added another thickener, an extreme pressure additive, an antioxidant, an oiliness improver, a rust inhibitor and a viscosity index improver to improve the performance characteristics of the resultant grease composition.

The content of the diurea compound acting as the thickener in the diurea grease composition of this invention should range from 2 to 25 wt %, preferably from 3 to 20 wt %, based on the total weight of the composition. If the content of the diurea compound is less than 2 wt %, the thickening capacity by the diurea compound is unsatisfactory. On the contrary, if the content of the diurea compound is more than 25 wt %, the resultant grease composition becomes too hard so as not to exhibit sufficient lubricating effect.

EXAMPLES OF THE INVENTION

The present invention will now be described more specifically with reference to some examples thereof. However, it is be noted here that the following Examples are given by way of example only and thus the invention should not be limited only to the following Examples.

EXAMPLE 1

8.12 g of diphenylmethane-4,4'-diisocyanate was added to 120 g of a mineral oil (10.5 cSt at @210° F.), and heated to 60° C. to be dissolved uniformly. Separately, 6.11 g of octadecylamine, 2.25 g of cyclohexylamine and 3.52 g of dicyclohexylamine were dissolved in 60 g of the same mineral oil by heating, and added to the mixture of the mineral oil and diphenylmethane-4,4'-diisocyanate under vigorous agitation, whereupon a thickened admixture was formed. After heating the admixture at 100° C. for additional 30 minutes under agitation, the thickened mass was passed through a roll mill to obtain a product grease. The thus produced grease contained 10 wt % of a diurea compound acting as a thickener, in which the ratio of octadecylamino group/cyclohexylamino group/dicyclohexylamino group was 35/35/30.

The thus produced diurea grease was subjected to the following tests to appraise the properties thereof, the results being shown in Table 1.

Tests for Appraisal of Properties of the Grease

Consistency: The worked consistencies (U/W and U/W after the lapse of one week from the production) and the unworked consistencies (60W and 100,000W)

were determined generally in accordance with the JIS K 2220 5.3 Method.

Dropping Point: The dropping point was determined generally in accordance with the Test for Dropping Point stipulated by JIS K 2220 5.4 Method.

Oil Separation: The oil separation was determined generally in accordance with the Test for Oil Separtion stipulated by JIS K 2220 5.7 Method, under the condition of 150° C.×200 hours.

EXAMPLE 2

8.17 g of 2,4–2,6-tolylenediisocyanate was added to 100 g of a mineral oil (10.5 cSt at @210° F.), and dissolved uniformly at the room temperature to obtain a first mixture. A second mixture of 9.21 g of octylamine, 1.77 g of cyclohexylamine and 0.85 g of dicyclohexylamine dissolved in 80 g of dioctyl sebacate was added to the first mixure under vigorous agitation. Whereupon, the admixture was thickened instantaneously. After continuing the agitation for 30 minutes, the temperature of the thickened admixture was raised to 80° C. and then the admixture was passed through a roll mill to obtain a product grease. The thus produced grease contained 10 wt % of a diurea compound acting as a thickener, in which the ratio of octylamino group/cyclohexylamino group/dicyclohexylamino group was 19/76/5.

The thus obtained diurea grease was subjected to tests for appraisal of the properties. The results are shown in Table 1.

EXAMPLE 3

9.91 g of bitolylenediisocyanate was added to 180 g of a low molecular weight polybutene (10.5 cSt at @210° F.), and dissolved uniformly by heating at 70° C. A uniform mixture of 1.26 g of laurylamine, 2.69 g of cyclohexylamine and 6.14 g of dicyclohexylamine was admixed to the mixture of polybutene and the bitolylenediisocyanate under vigorous agitation, whereupon a thickened mass was formed instantaneously. After continuing the agitation for 30 minutes, the temperature of the thickened admixture was raised to 120° C. and then the admixture was passed through a roll mill to obtain a product grease. The thus produced grease contained 10 wt % of a diurea compound acting as a thickener, in which the ratio of laurylamino group/cyclohexylamino group/dicyclohexylamino group was 40/10/50.

The thus obtained diurea grease was subjected to tests for appraisal of the properties. The results are shown in Table 1.

COMPARATIVE EXAMPLES 1 and 2

For comparison purpose, a commercially available Li-soap gease (Content of Gelatinizing Agent: 9 wt %; Comparative Example 1) and a commercially available tetraurea grease (Content of Gelatinizing Agent: 12.5 wt %; Comparative Example 2) were subjected to the same tests for appraisal of the properties thereof. The results are shown in Table 1.

COMPARATIVE EXAMPLE 3

8.09 g of diphenylmethane-4,4'-diisocyanate was added to 120 g of a mineral oil (10.5 cSt at @210° F.), and heated to 60° C. to be dissolved uniformly to obtain a first mixture. Separately, 8.70 g of octadecylamine and 3.20 g of cyclohexylamine were dissolved in 60 g of the same mineral oil by heating to obtain a second mixture. The second mixture was admixed to the first mixture under vigorous agitation, whereupon a thickened mass was formed instantaneously. After continuing the agitation for 30 minutes at 100° C., the thickened mass was then passed through a roll mill to obtain a product grease. The thus produced grease contained 10 wt % of a diurea compound acting as a thickener, in which the ratio of octadecylamino group/cyclohexylamino group was 50/50.

The thus obtained diurea grease was subjected to tests for appraisal of the properties. The results are shown in Table 1.

TABLE 1

| | Consistency | | | UW after | Dropping Point | Separation of Oil |
|---|---|---|---|---|---|---|
| | UW | 60 W | 100,000 W | One Week | (°C.) | 150° C. × 200 hr |
| Example 1 | 335 | 339 | 357 | 337 | 275 | 0.4 |
| Example 2 | 345 | 346 | 360 | 341 | 290 | 0.7 |
| Example 3 | 314 | 321 | 344 | 317 | 292 | 2.6 |
| Com. Ex. 1 | 289 | 297 | 381 | 295 | 207 | 1.5 |
| Com. Ex. 2 | 317 | 324 | 372 | 254 | 230 | 7.4 |
| Com. Ex. 3 | 305 | 316 | 340 | 230 | 273 | 0.7 |

As will be apparent from the results of appraisal tests set forth in Table 1, the diurea grease compositions of this invention have excellent properties in that the stability against shearing force is improved, that the dropping point is high, that the separation of oil at high temperature is only a little and that the hardening with the lapse of time is remarkedly decreased (in other words, the change in consistency with the lapse of time is small).

In contrast thereto, the commercially available Li-soap grease, Comparative Example 1, has a low dropping point and thus cannot be used at a high temperature. The commercially available tetraurea grease, Comparative Example 2, separates much oil at a high temperature. The diurea grease produced in accordance with the teaching of Japanese Patent Publication No. 11156/1980, Comparative Example 3, has a disadvantage that it becomes hard seriously with the lapse of time (in other words, the change in consistency with the lapse of time is large), although it has excellent stability against shearing force and a high dropping point, and only a little oil is separated at a high temperature. It should be thus clearly seen that the diurea grease composition of the invention has the properties superior over those of the known grease compositions.

Although the present invention has been described with reference to the specific examples, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. A diurea grease composition comprising a lubricant base oil and a thickener, said thickener consisting essentially of a mixture of at least two diurea compounds each being represented by the following general formula:

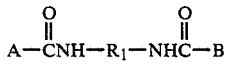

wherein $R_1$ is a difunctional aromatic hydrocarbon residue having 6 to 15 carbon atoms and each of A and B is selected from the group consisting of an amino group represented by the general formula (II) of $R_2$—NH— and an amino group represented by the general formula (III) of

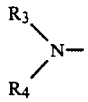

where $R_2$ is selected from the group consisting of a cycohexyl group, a group derived from cyclohexyl and having 7 to 12 carbon atoms and an alkyl group having 8 to 20 carbon atoms, and each of $R_3$ and $R_4$ is selected from the group consisting of a cyclohexyl group and a group derived from cyclohexyl and having 7 to 12 carbon atoms wherein the ratio in percentage of the numbers of the amino groups (III) to the total numbers of said amino groups (III) plus said amino groups (II) ranges from 1 to 50%, the ratio of the numbers of said amino groups (II) wherein $R_2$ is an alkyl group ranging from ¼ to 4/1, and the content of said thickener ranging from 2 to 25 wt % based on the total weight of the composition.

2. The diurea grease composition according to claim 1, wherein said diurea compound represented by the following general formula (I) of:

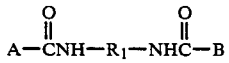

(I)

is prepared by reacting a diisocyanate represented by the general formula (IV) of OCN—$R_1$—NCO with a mixure of a primary amine represented by the general formula of $R_2$—$NH_2$ and a secondary amine represented by the general formula of

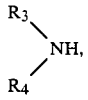

wherein A, B, $R_1$, $R_2$, $R_3$ and $R_4$ are the same as defined.

3. The diurea grease composition according to claim 1, wherein $R_1$ in said general formula (I) is selected from the group consisting of:

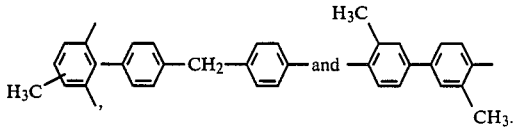

4. The diurea grease composition according to claim 1, wherein said cyclohexyl group and said group derived from cyclohexyl and having 7 to 12 carbon atoms is selected from the group consisting of cyclohexyl, methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl.

5. The diurea grease composition according to claim 1, wherein said alkyl group is selected from the group consisting of octyl, nonyl, decyl, undecyl, dodecyl, tridecyl, tetradecyl, pentadecyl, hexadecyl, heptadecyl, octadecyl, nonadecyl and eicosyl.

6. The diurea grease composition according to claim 1, wherein said lubricant base oil has a viscosity ranging within 2 to 40 cSt at @210° F.

7. The diurea grease composition according to claim 2, wherein said diisocyanate and said mixture of said primary amine and said secondary amine are reacted in the presence of a volatile solvent.

8. The diurea grease composition according to claim 7, wherein said volatile solvent is selected from the group consisting of benzene, toluene, xylene, hexane, naphtha, diisobutyl ether, carbon tetrachloride and petroleum ether.

9. The diurea grease composition according to claim 2, wherein said diisocyanate and said mixture of said primary amine and said secondary amine are reacted in the presence of a lubricant base oil.

10. The diurea grease composition according to claim 2, wherein said diisocyanate and said mixture of said primary amine and said secondary amine are reacted at a temperature of from 10° to 200° C.

* * * * *